US005580077A

United States Patent [19]

Dodge

[11] Patent Number: 5,580,077

[45] Date of Patent: Dec. 3, 1996

[54] RIDER SUPPORTING ASSEMBLY FOR SNOWBOARDS

[75] Inventor: David J. Dodge, Shelburne, Vt.

[73] Assignee: The Burton Corporation, Burlington, Vt.

[21] Appl. No.: 255,644

[22] Filed: Jun. 8, 1994

[51] Int. Cl.[6] ..... A63C 5/00

[52] U.S. Cl. ..... 280/607; 280/14.2

[58] Field of Search ..... 280/602, 607, 280/14.2, 618, 617

[56] References Cited

U.S. PATENT DOCUMENTS

| | | | |
|---|---|---|---|
| 4,067,593 | 1/1978 | Earl . | |
| 4,161,323 | 7/1979 | Wetteland . | |
| 4,221,394 | 9/1980 | Campbell | 280/14.2 |
| 4,294,460 | 10/1981 | Kirsch . | |
| 4,565,386 | 1/1986 | Crainich . | |
| 4,741,550 | 5/1988 | Dennis . | |
| 4,784,233 | 11/1988 | Favors . | |
| 4,804,200 | 2/1989 | Kuchler . | |
| 4,848,781 | 7/1989 | Dykema et al. . | |
| 4,896,895 | 1/1990 | Bettosini . | |

FOREIGN PATENT DOCUMENTS

| | | | |
|---|---|---|---|
| 2659246 | 9/1991 | France | 280/14.2 |
| 3702094 | 8/1988 | Germany | 280/14.2 |
| 9101938 | 11/1991 | Netherlands . | |

*Primary Examiner*—Richard M. Camby
*Attorney, Agent, or Firm*—Wolf, Greenfield & Sacks, P.C.

[57] ABSTRACT

A rider supporting assembly for use with a snowboard prevents convex bending of the snowboard between the rider's feet. As the rider bends the snowboard, a mounting plate having a controlled resilience restricts longitudinal bending of the snowboard in response to the rider so that the rider may easily impart a force to curve the snowboard following a convex bend (with respect to the rider) yet discourages any concave bending of the snowboard, especially along the snowboard located between the rider's feet.

18 Claims, 2 Drawing Sheets

RIDER SUPPORTING ASSEMBLY FOR SNOWBOARDS

This invention concerns a snowboard binding.

Snowboarding implies that the user's feet stay on the snowboard, and, to do this, it is known how to make straps attached to the board that clamp the feet on and immobilize them.

The different types of straps known to date have the serious disadvantage that in case of a fall, and particularly in case of a fall in rotation or frontward they do not allow the feet to be released and are the cause of many sprains, fractures or accidents to the joints and ligaments that are often serious due to the lateral position of the snowboarder's body, which makes the knees particularly vulnerable.

These straps also have the disadvantage of being permanently attached to the board and of not being able to be adjusted in position based on the different users' shapes, snow conditions or types of descent to be made. In particular, since the feet do not have to be parallel on the board and the foot located near the front is in an oblique position of around 45 degrees in relation to the longitudinal axis of the board, with the toes turned toward the tip, two users, depending on whether they are left-handed or right-handed and whether they put the same foot forward, could not use the same board. The result is that the people who rent boards have to have a large stock of boards more or less adapted to different users.

This invention is aimed at fixing these disadvantages by providing a binding that can effectively hold the feet and can be adapted to their different positions depending on the user, while allowing them to be released instantaneously in case of a fall and particularly in case of a fall forward, in rotation or to the left or right.

For this purpose, the device that the invention concerns includes a plate, with dimensions less than those of the board, that has straps that can immobilize the user's feet on it; the plate is designed, using appropriate means of hooking and unhooking, to be mounted on the board so it can be detached and used to support the user; the above-mentioned means and the plate are designed to allow both attachment resistant to the forces normally exerted during use of the board, some play in the plate in relation to the board to absorb vibrations and let the plate and the board pop apart when the user falls.

With this device, the feet can be released in a fall without compromising the normal use of the board.

Advantageously, the plate has two parts, held against one another on the board when it is being used and provided to allow each of the feet to be released independently of the other in the event of a fall.

Preferably, the straps and the plate are designed so the position of the straps can be adjusted. The plate can be designed to be reversible, so the straps can be attached on both sides of it.

Because the position of the straps can be adjusted, it is possible to adapt the board to the user's shape, the snow conditions or the type of descent to be made. The plate's reversibility makes it possible to adjust the orientation of the straps based on the foot position the user wants.

According to one preferred form of embodiment of the invention, the plate is mounted so it can pivot around a finger that is integral to the board, and the means for hooking it on the board are composed, on one hand, of a clip that has two jaws, located on either side of the above-mentioned clip that run parallel and in the opposite direction from one another, in a direction perpendicular to the axis of the board, with the curved ends of the jaws being held by appropriate elastic means in grooves made in the edge of the plate near two semi-circular recesses that it has on its lateral edges which are centered on the jaws and, on the other hand, by a slide, attached to the front of the board, and by an attachment located on the back of the board that has a moving part subject to the action of appropriate elastic means that tend to maintain a horizontal groove that fits over a corresponding rib on the edge of the board.

Advantageously, means are provided to adjust the force exerted by the above-mentioned elastic means on the parts that are associated with them.

In any case, the invention will be understood from the description that follows, which refers to the appended schematic drawing showing one preferred form of embodiment of the device in the invention, as a non-limiting example.

FIG. 1 is a perspective view of it;

FIG. 2 is a view similar to FIG. 1, in exploded perspective; and

FIGS. 3 and 4 are sectional views of it, according to III—III and IV—IV in FIG. 1, respectively.

FIG. 5 is a standoff plate and supporting pad in an alternative embodiment.

FIGS. 1 and 2 represent a snowboard 2 on which the binding 3 in the invention is mounted.

The device 3 includes a plate 4 mounted so it can pivot around a finger 5 that is integral to the cover 6 of a box 7.

The plate 4 is composed of two longitudinal parts **4*a* and 4*b* held one against the other on the board 2 under normal conditions of use by the jaws 8 of a clip 9, a guiding slide 10 that is part of the board 2 in which a complementary part 11 that is integral to the board 4 slides and a back binding 12**.

To keep parts **4*a* and 4*b* of the board 4 in position in relation to one another, one 4*a* of the parts 4*a* and 4*b* has, on the edge in contact with the other part 4*b*, a projecting rib 15 designed to fit into a corresponding groove 16 made in the edge of part 4*b***.

In addition, parts **4*a* and 4*b* each have a recess in the middle 17 designed for a metal part 20, one U-shaped part 20*a* of which has holes 23 for attaching it to the part 4*a* or 4*b* that it equips; one part 20*b* has a half-hub pivoting around the finger 5 and an intermediate part 20*c* delimits, with the walls of parts 20*a* and 20*b*, a space 21 into which a guide roller 22 mounted on the cover 6 is designed to fit, as can be seen particularly in FIG. 3**.

Moreover, parts **4*a* and 4*b* include two units 24*a* and 24*b* of transverse slits 25 aligned and parallel to one another, into which the wings 27*a* of stirrups 27 are designed to fit; these wings 27*a* have holes for branches 29*a* of straps 29 designed to hold part of the user's shoe 31 (FIG. 3) and can be maneuvered and locked by means of a lever 30**.

By putting the stirrups 27 into certain slits 25 or in others, the position of the straps 29 can be adjusted and their distance from one another, based on the user's shape, the snow conditions or the type of descent to be made.

The slit lines 25 of the unit **24*a* are not parallel to those of unit 24*b*. This makes it possible to give the foot located on the front of the board 2 the optimal orientation, that is, an oblique position of around 45 degrees in relation to the axis of the board. In comparing FIGS. 1 and 2, it is important to note that the board 4 can be used in both directions. Because of this reversibility of the board 4**, it is possible to adapt the orientation of the user's front foot, depending on whether he is left-handed or right-handed.

As can be seen in FIGS. 1 and 3, the jaws 8 are located on both sides of the finger 5, and their curved ends 8*a* fit into the grooves 35 made in rails 36 attached to the side of the board 4, near two semi-circular recesses 37 on the sides that are centered on the jaws 8. The jaws can slide across the side wall 7*a* of the box 7.

The other end of each jaw 8 has a finger 40 supported against one edge 41*a* of the end 41*b* in the form of a triangle of a branch 41, the other end 41*c* of which is extended by a circular wall 42 against which is supported one end of a helicoidal spring 43, housed inside the back binding 12, whose other end is supported against a threaded stopper 45 that fits over an inside thread 46 in the wall of the binding 12.

The binding 12 also has an L-shaped moving piece 52, part 52*a* of which has a rod 53 that goes through a bore made in the binding 12, and the tubular end 53*a* of which houses a helicoidal spring 54 that fits over a guide finger 55. The part 52*a* of the moving piece 52 also has a horizontal groove 56 that goes over a corresponding rib 57 on the edge of the board 4.

In practice, under normal conditions of use, the plate 4 is kept on the board 2, and the hooking that results from putting the ends 8*a* of the jaws 8 in the grooves 35, the piece 11 in the slide 10 and the groove 56 over the rib 57 is enough to resist the forces exerted on the board 2 and the plate 4 during such use, due to the action of the spring 43, which by pushing the rod 41 forward, tends to keep the end 8*a* of the jaw 8 in the bottom of the grooves 35, and by the action of the spring 54, which by pushing the moving piece 52 forward, tends to keep the groove 56 on the rib 57. This allows the parts 20 to lock passively; and the latter, the rollers 22 and the cover 6 also allow distribution of the forces transmitted by the plate 4.

When the user is off balance causing him to fall sideways, the plate 4 pivots around the finger 5. The end 8*a* of the jaws 8 slides into the grooves 35 until, if the rotation of the plate 4 continues, it is released, which makes the plate 4 pop out of the board 2 and parts 4*a* and 4*b* separate, which instantly releases the user's feet.

During this rotation movement, the slide 10 and the groove 56 of the part 52 guide the plate 4. When the ends 8*a* of the jaws 8 get close to the ends of the rails 36, the spring 43 is compressed, and the pressing that the spring 54 exerts on the piece 52 is reduced, as well as the contact surface of the rib 57 with the groove 56, due to the rounded shape of the back of the plate 4, which helps the plate 4 and the board 2 pop apart. The spaces 21 which, due to the shape of the part 20*b* of the pieces 20, splay toward their ends, no longer play their role of guiding and holding the plate 4 when it is pivoted. The play thus introduced between the rollers 22 and the parts 20 also tends to help the plate 4 pop apart from the board 2.

When the user falls forward, the rib 57 and the end 8*a* of the jaws 8, respectively, come out of the grooves 56 and 35, which makes it pop apart, as mentioned above and releases the feet.

Action on the stopper 45 makes it possible to adjust the return force exerted on the jaws 8 and the moving piece 52.

Obviously the invention is not limited to the form of embodiment described below as an example. On the contrary, it includes all variations based on the same principle. Thus, one would not go beyond the invention by eliminating the rod 41 and replacing it in the box 7 by one or more springs supported by their ends against the fingers 40 and held between the parts of the jaws 8 located within the box 7.

What is claimed is:

1. In combination, a rider supporting assembly and a snowboard; said combination comprising:

a snowboard;

and a rider supporting assembly including an elongated mounting plate having a first section and a second section and a pair of snowboard boot bindings attached to said mounting plate directly over said first and second sections, respectively;

said mounting plate being non-releasably attached to said snowboard at said first and second sections so that said mounting plate cannot detach from said snowboard during use by the rider, wherein said combination is constructed and arranged so that snowboard may bend in a convex configuration between said first and second sections in response to forces applied to it by the snow but will not bend in a longitudinal concave configuration between said first and second sections in response to rider induced forces, said mounting plate and said snowboard being attached so as to permit limited longitudinal movement therebetween as said snowboard bends in a convex configuration.

2. The combination recited in claim 1, wherein said mounting plate is generally dog bone shaped.

3. The combination recited in claim 1 wherein said mounting plate includes a longitudinally extending oblong hole.

4. The combination recited in claim 1 further including a resilient pad and a rigid standoff plate which are disposed between said mounting plate and said snowboard.

5. The combination recited in claim 4, wherein said resilient pad is disposed adjacent to said mounting plate and said stand-off plate is disposed adjacent to said snowboard.

6. The combination recited in claim 5, wherein said resilient pad is received in a recess of said mounting plate.

7. The combination recited in claim 6, wherein said resilient pad includes a metal washer.

8. The combination recited in claim 6, further including a mushroom-shaped spacer disposed between said stand-off plate and said mounting plate.

9. The combination recited in claim 4 further including at least two spaced apart fixation locations at each of said first and second sections where said mounting plate is fixed to said snowboard, said resilient pad being mounted between said snowboard and said mounting plate and between said two spaced apart fixation locations.

10. A snowboard and binding mount assembly, comprising:

a snowboard;

an elongated binding mount plate fixedly attached to said snowboard at first and second spaced locations so that said elongated binding mount plate cannot detach from said snowboard during use by a rider, said elongated binding mount plate being mounted to said snowboard for limited relative longitudinal movement therebetween and supporting a pair of bindings directly over said first and second spaced locations, wherein there are no points of attachment of said elongated binding mount plate and said snowboard between said first and second spaced locations.

11. The snowboard and binding mount assembly recited in claim 10 wherein said snowboard and said elongated binding mount plate are constructed and arranged so that said snowboard will bend between said first and second spaced locations in a convex configuration away from the rider in response to contact with the snow but will not longitudinally concave bend between said first and second spaced locations in response to forces induced by the rider.

12. The snowboard and binding mount assembly recited in claim 10 including a fixed junction at said first location and a sliding junction at said second location for fixedly attaching said elongated binding mount to said snowboard while permitting limited relative longitudinal movement therebetween.

13. The snowboard and binding mount assembly recited in claim 12 wherein said sliding junction includes a post and an elongated slot arrangement wherein said elongated slot is longer than a thickness of said post and extends in the direction of relative movement between said elongated binding mount plate and said snowboard.

14. The snowboard and binding mount assembly recited in claim 10 further including a resilient pad disposed between said snowboard and said elongated binding mount plate.

15. The snowboard and binding mount assembly recited in claim 10 wherein said elongated binding mount plate includes first and second ends which are constructed and arranged to allow convex bending of said snowboard.

16. The snowboard and binding mount assembly recited in claim 10 further including at least one fastener for attaching said elongated binding mount plate to said snowboard, said elongated binding mount plate including a resilient material that contacts said fastener.

17. The snowboard and binding mount assembly recited in claim 16 wherein said resilient material is supported in a recess in a surface of said elongated binding mount plate.

18. The snowboard and binding mount assembly recited in claim 17 wherein said resilient material further includes a washer for distributing forces applied to said fastener.

* * * * *

UNITED STATES PATENT AND TRADEMARK OFFICE

CERTIFICATE OF CORRECTION

PATENT NO. : 5,580,077
DATED : Dec. 03, 1996
INVENTOR(S) : David J. Dodge

It is certified that error appears in the above-identified patent and that said Letters Patent is hereby corrected as shown below:

Please delete columns 1-6 and substitute columns 1-6 as per attached.

Signed and Sealed this

Fifteenth Day of September, 1998

*Attest:*

Bruce Lehman

BRUCE LEHMAN

*Attesting Officer*

*Commissioner of Patents and Trademarks*

RIDER SUPPORTING ASSEMBLY FOR SNOWBOARDS

FIELD OF THE INVENTION

The present invention relates generally to snowboards and, more particularly, concerns a supporting assembly for securing both of a rider's boots to the snowboard.

BACKGROUND OF THE INVENTION

The use of foot-plates with downhill-type skis is known and is shown, for example, in U.S. Pat. No. 4,294,460 issued to Kirsch. The foot-plate disclosed in the 4,294,460 patent is used as a connecting interface (one per ski) between each ski binding and the upper surface of the respective ski. The foot-plate assembly of the 4,294,460 patent is intended to prevent transmission through the ski bindings and to the rider of movement stresses which are generated as the ski flexes longitudinally and laterally during its normal use. Such stresses would usually be transmitted from bindings to ski boots and, eventually, through the limbs of the rider, much to his discomfort.

The foot-plate of the 4,294,460 patent is a rectangular plate made of a material which is sufficiently rigid to support mounted ski bindings properly. The foot-plate is about as wide as the width of the ski and slightly longer than the distance between a front and a rear binding portion of each ski. Each foot-plate of the 4,294,460 patent receives the front and rear ski bindings of the respective ski along its upper surface and is resiliently secured to the upper surface of the ski using a combination of rigid fasteners and flexible material. The foot-plate assembly of the 4,294,460 patent functions as a simple shock-absorber to effectively dampen the transmission of the stress movements generated by the ski, thereby eliminating any associated discomfort to the rider.

The sport of snowboarding, although similar in certain regards, is very different from conventional downhill skiing. The most obvious difference is the use of a single wide ski-like snowboard instead of two independently controllable slender downhill-type skis.

Since the rider's legs are both connected to the same ski (the snowboard), the rider will inherently impart a flexing moment to the snowboard as he performs the various maneuvers associated with the sport. Downhill skis are flexible and will bend as they are used. However, since each leg of the downhill skier is mechanically isolated from each other, downhill skiers will not impart any great twisting or bending to either ski through body and leg movement during the normal use of the ski. The movements of each leg of the downhill skier is not dependent on the movements of the other leg and is free to direct its ski, for the most part, without restriction. The lack of a fixed leverage point (about which a leg may impart bending), other than the snow surface, prevents either downhill ski from independent bending or twisting. Conversely, in order to achieve the various maneuvers associated with the sport of snowboarding, the rider must manipulate the snowboard much like a skateboard. Certain turning maneuvers (and general snowboarding movements) either force the rider to bend the snowboard or result in the bending of the snowboard with respect to its central longitudinal axis. This bending or board distortion forces the otherwise flat-bottomed snowboard into a curved (either concave or convex) shape. Convex curving is desirable. However, it is not uncommon for the rider to impart concave (curved upward towards the rider) distortion between the rider's feet. This convex curving or distortion causes the snowboard to behave unpredictably during a turning maneuver, particularly at high speeds. During a turn, if the snowboard is allowed to concave bend between the feet of the rider, the portion of the edge of the snowboard lifts from the surface of the snow, resulting in the snowboard sliding out from the turn.

Ideally, the above-described rider-initiated longitudinal concave distortion of the snowboard should be minimized or eliminated without restricting desirable convex bending of the snowboard or other longitudinal flexing of the snowboard caused by the terrain of the snow. The rider should be rigidly connected to the snowboard to ensure quick maneuvering response, yet the snowboard should be isolated from unwanted movements of the rider, such as movements which cause the above-described longitudinal concave distortion.

Owing to the different movements imparted by the rider and the resulting physical demands placed on the equipment, the above discussed foot-plates of the 4,294,460 patent, although they could provide some shock absorption, would not be suitable for use with a snowboard. First of all, utilizing the foot-plates as in the 4,294,460 patent would fail to prevent the above described unwanted longitudinal bending (concave) of the snowboard. Secondly, the shock absorption provided by the foot-plates of the patent would not only dampen higher frequency vibrations and oscillations between the snowboard and its rider, but would also dampen the otherwise quick response of the rider. Thus, the rider's dynamic control of the snowboard is substantially diminished.

U.S. Pat. No. 4,741,550 issued to Dennis discloses a binding system for use with snowboards wherein each of the rider's boots is connected to a respective boot binding through a resilient mount. Similar to the above-described U.S. Pat. No. 4,294,460, the resilient mounts of the 4,741,550 patent isolate the movements of the boots from the snowboard. This arrangement reduces the response time of each of the rider's movements and limits the degree of bending and twisting that may be imparted to the snowboard as it is used and it does not dampen or reduce the above-described unwanted longitudinal distortion.

It is, therefore, an object of the present invention to provide a rider supporting assembly for use with snowboards which reduces rider-induced unwanted longitudinal concave bending of the snowboard without adversely restricting convex bending of the snowboard to the snow or its responsiveness to the rider.

In accordance with the present invention, a rider supporting assembly for use with a snowboard restricts concave longitudinal bending of the snowboard in response to the rider yet allows the snowboard to twist and convex bend in response to contact with the snow. The supporting assembly comprises an elongated mounting plate which has a first and a second end section, a middle section, an upper surface and a lower surface. The middle section is made narrower than the end sections to conserve weight. A first boot binding is mounted to the mounting plate along its upper surface at the first end section, and a second boot binding is mounted to the mounting plate along its upper surface at the second end section. Also, the first and second end sections of the mounting plate are connected to the snowboard so as to permit flexing in the mounting plate in response to the forces exerted thereon through the boot bindings, while permitting movement of the mounting plate relative to the snowboard, thereby minimizing concave bending of the snowboard.

BRIEF DESCRIPTION OF THE DRAWINGS

The foregoing brief description, as well as further objects, features and advantages of the present invention will be understood more completely from the following detailed description of a presently preferred, but yet illustrative, embodiment of the invention, with reference to the accompanying drawings, in which.

DETAILED DESCRIPTION OF THE PREFERRED EMBODIMENT

Figure 1:
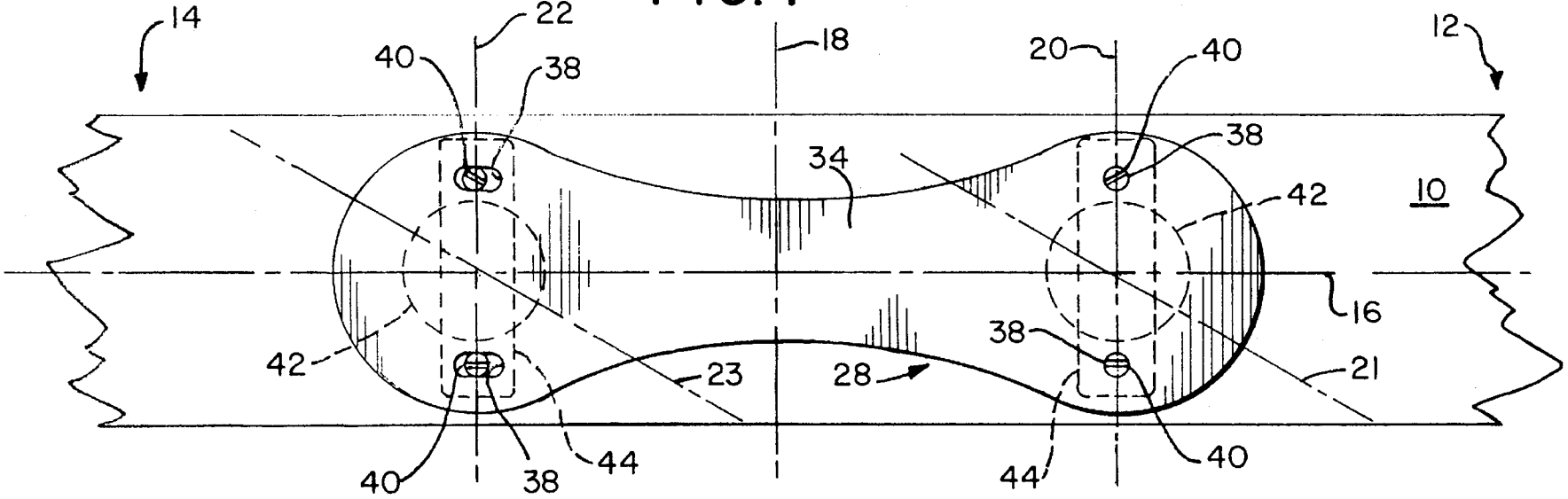
FIG. 1 is a top plan view of the mounting assembly attached to a snowboard (partially shown), in accordance with the preferred embodiment of the invention.
Figure 2:
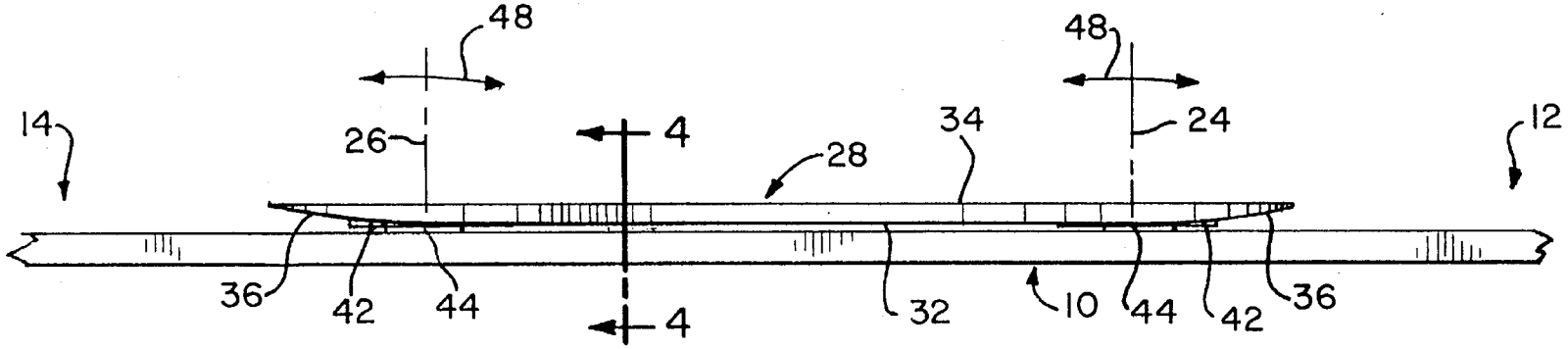
FIG. 2 is a side view of the mounting assembly shown in FIG. 1.

Referring to FIGS. 1 and 2, a snowboard 10 of conventional construction is shown in part, and it has a front 12 and a rear 14, a central longitudinal axis 16 and a central lateral axis 18, a front binding axis 20, a front mounting axis 21, a rear binding axis 22 and a rear-mounting axis 23. Conventional boot bindings (not shown) may be mounted to a mounting plate 28 (described in detail below) so as to be directed along the front and rear shoe axes 20, 22, respectively. The bindings are mounted so as to be adjustable pivotally about a point defined by the intersection of the longitudinal axis 16 and the respective front and rear mounting axes 20, 22. In addition, mounting plate 28 is subjected to bending as a result of torques 48, 48 produced about front and rear axis 24 and 26 as a result of the user's efforts to control the snowboard, as well as torque 46 (see FIG. 4). The front and rear upright axes 24, 26 are both located along the central longitudinal axis 16 and the respective front and rear mounting axes 21, 23, and are perpendicular to the surface of the snowboard 10. The front and rear axes 24, 26 in part define an upright longitudinal plane 25 (see FIG. 4) through the central longitudinal axis.

Mounting plate 28 is connected to the upper surface of the snowboard 10. The mounting plate 28 includes a longitudinal axis 16, a lower surface 32 and an upper surface 34, and it is preferably elongated with rounded ends and a narrow center, similar in shape to a dog bone. The mounting plate 28 is made from a composite skinned wood or foam core laminate construction and is preferably slightly arched upward (convex surface facing upward), away from the snowboard 10, as shown in FIG. 2. Bevelled edges 36 are provided along the lower surface 32 of the mounting plate 28 to provide clearance with the snowboard in the event that the mounting plate 28 or the snowboard 10 bends about its longitudinal axis 16. The middle section of the mounting plate 28 is sufficiently rigid to limit bending movement of the front end section 12 with respect to the rear end section 14 about the central lateral axis 18.

Figure 3:
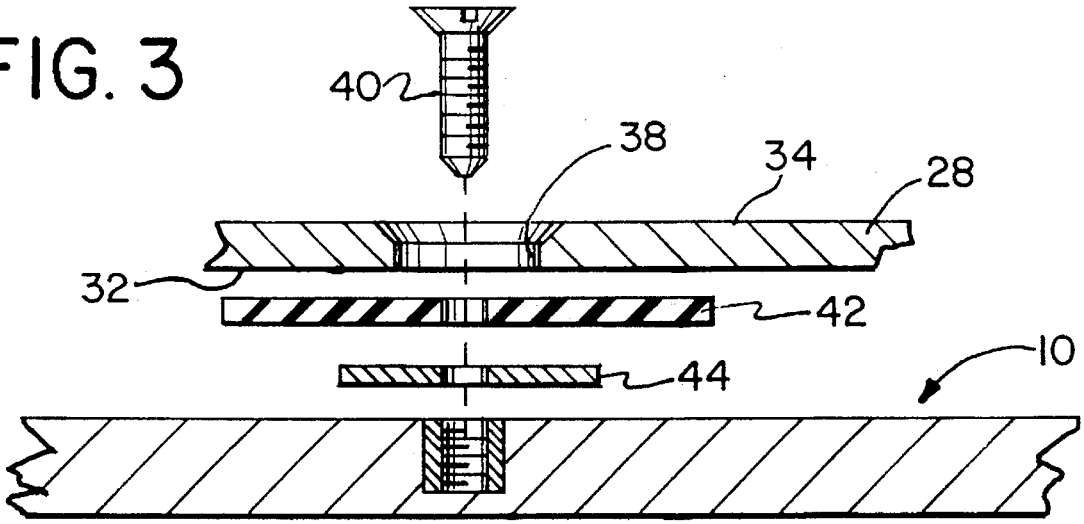
FIG. 3 is an enlarged side view showing details of a standoff plate and a supporting pad, in accordance with the preferred embodiment.

The mounting plate 28 is preferably attached to the snowboard 10 at four points 38, using any appropriate fastener 40, such as screws or bolts as shown in FIG. 3. Two of the connecting points 38 are located along the front binding axis 20, while the remaining two connecting points 38 are located along the rear binding axis 22. The two holes 38 on the left in FIG. 1 are slightly oblong to permit bending of snowboard 10 relative to the mounting plate 28. Located between the lower surface 32 of the mounting plate 28 and the snowboard 10, and along both respective mounting axes 21, 23, is a pad 42 and a rigid stand-off plate 44, as shown in FIG. 3. The stand-off plate is preferably a metal, such as aluminum, and is located adjacent the upper surface of the snowboard 10. The pad 42 is preferably made from a resilient shock-absorbing material, such as rubber. The resilient pad 42, which is positioned between the stand-off plate 44 and the mounting plate 28 provides some cushioning with respect to the snowboard 10 and allows the rider to easily convex bend the snowboard 10 into a tight turn without restriction. Additionally, the mounting arrangement between the mounting plate and the snowboard substantially prevents the snowboard from being subject to longitudinal concave bending between the front and rear sections in a direction toward the upper surface of the mounting plate 28.

Figure 4:
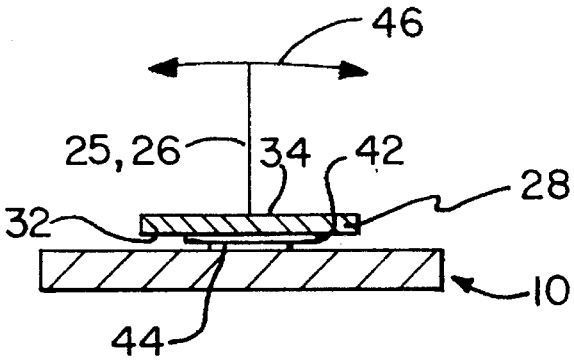
FIG. 4 is a sectional view of the mounting assembly taken along the lines 4—4 of FIG. 2.
Figure 5:
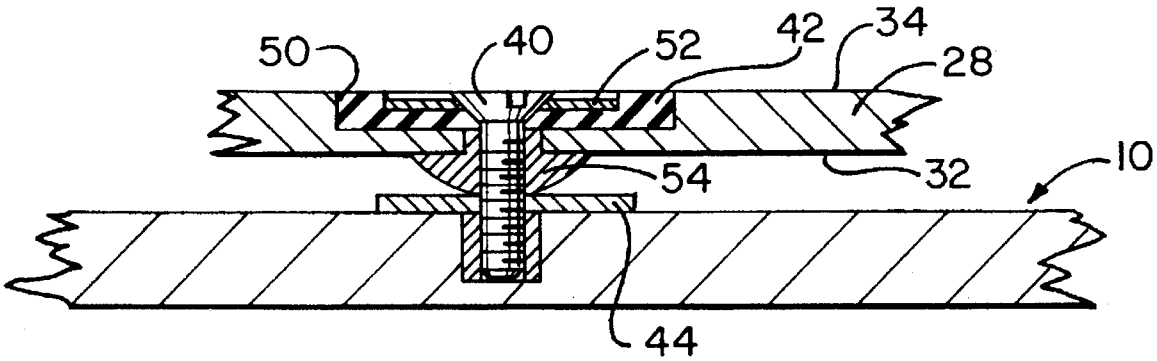
FIG. 5 is an enlarged side view showing details of a standoff plate and a supporting pad, in accordance with another embodiment of the invention.

Referring to FIG. 5, another embodiment of the fastening system used to secure the mounting plate 28 to the snowboard 10 is shown. Here, the mounting plate 28 is secured to the upper surface of the snowboard 10 using a fastener 40. The pad 42 is now positioned in an appropriate recess 50 located within the upper surface of the mounting plate 28. Located within the pad 42 is a metal washer 52 used to help distribute applied forces. This arrangement, similar to the one shown in FIG. 3 and discussed above, includes a standoff plate 44 located between the snowboard 10 and the mounting plate 28. Positioned between the standoff plate 44 and the mounting plate 28 is a mushroom-shaped spacer 54, preferably made from a strong rigid material such as a metal. The spacer 54 is positioned with its rounded side against the standoff plate 44. Appropriate openings located in the washer 52, the pad 42, the mounting plate 28, the space 54 and the standoff plate 44, align to receive the fastener 40, which again is received in a threaded bore located in the snowboard. The operation of the arrangement shown in FIG. 4 is similar to that of FIG. 3, except that here greater height is provided between the snowboard 10 and the mounting plate 28 allowing greater convex bending to the snowboard 10.

The mounting plate 28 is preferably constructed to encourage slight controlled and uniform convex bending of the snowboard 10 about its longitudinal axis 16 with respect to the rider, yet discourages any undesirable concave bending of the snowboard 10 about the central lateral axis 18 and especially adjacent to the mounting plate 28 and under the rider's weight (between the rider's feet). This allows the snowboard to maintain a desired convex shape which helps apply the rider's weight to the edges of the snowboard 10, especially the inside edges of a turn. The mounting plate 28 effectively allows the rider to only convex bend the snowboard, and prevents any concave bending (somewhat rippled or wavy) along the longitudinal axis and between the rider's feet.

As will be appreciated from FIG. 2, the torques 48 applied simultaneously at each end of the mounting plate 28 will cause desirable convex bending of the snowboard 10. The torques 48, 48 applied simultaneously at each end of the mounting plate 28 would, if not prevented by the mounting plate 28, create an undesirable concave curve to the snowboard 10.

The lateral torques 46 in FIG. 4 will be transmitted to the snowboard causing it to tilt so as to apply the rider's weight to the edges. Thus, the mounting plate 28 not only prevents undesirable concave bending movement along the central lateral axis 18, as discussed above, but also allows even distribution of the rider's weight and force along the edge of the snowboard 10 regardless of the rider's stance. The distribution of the weight and force may therefore be controlled easily by the relative position and orientation of the standoff plates 44 on the snowboard 10.

Although a preferred embodiment of the invention has been disclosed for illustrative purposes, those skilled in the art will appreciate that many additions, modifications, and substitutions, in addition to those specifically discussed, are possible, without departing from the scope and spirit of the invention as defined by the accompanying claims. For example, the mounting plate need not be dog bone shaped, but could have another shape that would make it more flexible or stiffer in the middle. This could be achieved by controlling the thickness of the middle portion or the relative rigidity of the material used to make the middle portions and the two end portions. Also, it is contemplated that the snowboard itself could be manufactured to incorporate (perhaps as a laminate) the mounting plate 28 so that the snowboard functions as described above, without the need of the separate mounting plate 28.

What is claimed is:

1. In combination, a rider supporting assembly and a snowboard, said combination comprising:

a snowboard;

and a rider supporting assembly including an elongated mounting plate have a first section and a second section and a pair of snowboard boot bindings attached to said mounting plate directly over said first and second sections, respectively;

said mounting plate being non-releasably attached to said snowboard at said first and second sections so that said mounting plate cannot detach from said snowboard during use by the rider, wherein said combination is constructed and arranged so that snowboard may bend in a convex configuration between said first and second sections in response to forces applied to it by the snow but will not bend in a longitudinal concave configuration between said first and second sections in response to rider induced forces, said mounting plate and said snowboard being attached so as to permit limited longitudinal movement therebetween as said snowboard bends in a convex configuration.

2. The combination recited in claim 1, wherein said mounting plate is generally dog bone shaped.

3. The combination recited in claim 1 wherein said mounting plate includes a longitudinally extending oblong hole.

4. The combination recited in claim 1 further including a resilient pad and a rigid standoff plate which are disposed between said mounting plate and said snowboard.

5. The combination recited in claim 4, wherein said resilient pad is disposed adjacent to said mounting plate and said stand-off plate is disposed adjacent to said snowboard.

6. The combination recited in claim 5, wherein said resilient pad is received in a recess of said mounting plate.

7. The combination recited in claim 6, wherein said resilient pad includes a metal washer.

8. The combination recited in claim 6, further including a mushroom-shaped spacer disposed between said stand-off plate and said mounting plate.

9. The combination recited in claim 4 further including at least two spaced apart fixation locations at each of said first and second sections where said mounting plate is fixed to said snowboard, said resilient pad being mounted between said snowboard and said mounting plate and between said two spaced apart fixation locations.

10. A snowboard and binding mount assembly, comprising:

a snowboard;

an elongated binding mount plate fixedly attached to said snowboard at first and second spaced locations so that said elongated binding mount plate cannot detach from said snowboard during use by a rider, said elongated binding mount plate being mounted to said snowboard for limited relative longitudinal movement therebetween and supporting a pair of bindings directly over said first and second spaced locations, wherein there are not points of attachment of said elongated binding mount plate and said snowboard between said first and second spaced locations.

11. The snowboard and binding mount assembly recited in claim 10 wherein said snowboard and said elongated binding mount plate are constructed and arranged so that said snowboard will bend between said first and second spaced locations in a convex configuration away from the rider in response to contact with the snow but will not longitudinally concave bend between said first and second spaced locations in response to forces induced by the rider.

12. The snowboard and binding mount assembly recited in claim 10 including a fixed junction at said first location and a sliding junction at said second location for fixedly attaching said elongated binding mount to said snowboard while permitting limited relative longitudinal movement therebetween.

13. The snowboard and binding mount assembly recited in claim 12 wherein said sliding junction includes a post and an elongated slot arrangement wherein said elongated slot is longer than a thickness of said post and extends in the direction of relative movement between said elongated binding mount plate and said snowboard.

14. The snowboard and binding mount assembly recited in claim 10 further including a resilient pad disposed between said snowboard and said elongated binding mount plate.

15. The snowboard and binding mount assembly recited in claim 10 wherein said elongated binding mount plate includes first and second ends which are constructed and arranged to allow convex bending of said snowboard.

16. The snowboard and binding mount assembly recited in claim 10 further including at least one fastener for attaching said elongated binding mount plate to said snowboard, said elongated binding mount plate including a resilient material that contacts said fastener.

17. The snowboard and binding mount assembly recited in claim 16 wherein said resilient material is supported in a recess in a surface of said elongated binding mount plate.

18. The snowboard and binding mount assembly recited in claim 17 wherein said resilient material further includes a washer for distributing forces applied to said fastener.

* * * * *